US009579000B1

(12) United States Patent
Morris et al.

(10) Patent No.: US 9,579,000 B1
(45) Date of Patent: Feb. 28, 2017

(54) TOILET PAPER HOLDER WITH A WET-WIPE CONTAINER BODY

(71) Applicants: John Morris, Centerville, UT (US); Allison Rae Morris, Centerville, UT (US)

(72) Inventors: John Morris, Centerville, UT (US); Allison Rae Morris, Centerville, UT (US); John Henry Morris, Centerville, UT (US)

( * ) Notice: Subject to any disclaimer, the term of this patent is extended or adjusted under 35 U.S.C. 154(b) by 0 days.

(21) Appl. No.: 15/173,261

(22) Filed: Jun. 3, 2016

Related U.S. Application Data

(60) Provisional application No. 62/319,375, filed on Apr. 7, 2016.

(51) Int. Cl.
*B65H 49/18* (2006.01)
*A47K 10/38* (2006.01)
*A47K 10/32* (2006.01)

(52) U.S. Cl.
CPC ..... *A47K 10/38* (2013.01); *A47K 2010/3266* (2013.01); *A47K 2010/389* (2013.01); *B65H 2407/40* (2013.01); *B65H 2701/533* (2013.01)

(58) Field of Classification Search
CPC ..... A47K 10/22; A47K 10/24; A47K 10/32; A47K 10/38; A47K 10/40; A47K 2010/389; A47K 2010/3266; B65H 75/08; B65H 75/10; B65H 2701/52; B65H 2701/533
See application file for complete search history.

(56) References Cited

U.S. PATENT DOCUMENTS

| | | | | |
|---|---|---|---|---|
| 2,801,809 | A * | 8/1957 | Glaner | A47K 10/22 242/560 |
| 3,002,704 | A * | 10/1961 | Grossfeld | A47K 10/32 242/599.1 |
| 3,848,822 | A * | 11/1974 | Boone | A47K 10/40 239/52 |
| 5,192,044 | A | 3/1993 | Baskin | |
| D377,284 | S | 1/1997 | Farrow et al. | |
| 5,623,880 | A * | 4/1997 | Kuntz | A47K 10/38 108/42 |
| 5,967,452 | A | 10/1999 | Wilder | |
| 6,857,540 | B2 | 2/2005 | Mitchell | |
| 6,959,890 | B1 | 11/2005 | Breitinger | |

(Continued)

FOREIGN PATENT DOCUMENTS

JP 2011-167335 A 9/2011

*Primary Examiner* — William A Rivera
(74) *Attorney, Agent, or Firm* — Lowenstein Sandler LLP

(57) ABSTRACT

A toilet paper roll holder with wet wipe is described. In one embodiment, a system includes an elongated container body, a first endcap, a second endcap, at least one connector, and a bias member. The elongated container body has a central first axis, an internal storage space, a first end, and a second end. The elongated container body fits within a toilet paper roll. The first endcap is coupled to the first end of the elongated container body. The second endcap is coupled to the second end of the elongated container body. The second endcap includes an access lid to provide access to the internal storage space. The at least one connector is to secure the system relative to a mounting location on a second axis. The bias member is on a third axis. The bias member is coupled between the at least one connector and the elongated container body.

20 Claims, 8 Drawing Sheets

(56) References Cited

U.S. PATENT DOCUMENTS

| | | | | |
|---|---|---|---|---|
| 7,354,598 | B2 * | 4/2008 | Masting | A47K 10/3809 424/400 |
| 7,367,524 | B2 | 5/2008 | Burnett | |
| 7,438,255 | B2 * | 10/2008 | Burnett | A47K 10/3836 242/597.5 |
| 7,527,217 | B2 * | 5/2009 | Burnett | A47K 10/40 242/560 |
| 7,559,434 | B2 | 7/2009 | Masting | |
| 7,694,848 | B2 | 4/2010 | Petry | |
| 7,866,593 | B2 | 1/2011 | Friesen et al. | |
| D666,443 | S | 9/2012 | Yaros | |
| 8,444,007 | B2 | 5/2013 | Hatter et al. | |
| 8,474,652 | B2 | 7/2013 | Yaros | |
| RE45,809 | E | 11/2015 | Hatter et al. | |
| 9,271,616 | B2 | 3/2016 | Yaros | |
| 2002/0053624 | A1 | 5/2002 | Newman et al. | |
| 2011/0284570 | A1 * | 11/2011 | Hatter | A47K 10/32 221/26 |
| 2012/0181297 | A1 | 7/2012 | Cofrancesco | |
| 2013/0161346 | A1 | 6/2013 | Wolme et al. | |
| 2013/0192437 | A1 | 8/2013 | Sahlberg | |
| 2015/0069172 | A1 | 3/2015 | Bricker | |
| 2015/0083743 | A1 * | 3/2015 | D'Angelo | A47K 10/38 221/45 |

* cited by examiner

TOILET PAPER HOLDER WITH A WET-WIPE CONTAINER BODY

RELATED APPLICATION

This application claims the benefit of U.S. Provisional Application No. 62/319,375, filed Apr. 7, 2016, the entire contents of which are incorporated herein by reference.

BACKGROUND

Despite multiple attempts to improve the adoption of wet wipes by consumers, the disposable wipe industry has been slow to gain market share on the toilet paper field. One option for making disposable wipes accessible to a consumer is a package or container that typically sits on a counter top. However, this option does not fit within the typical bathroom experience of a consumer who is accustomed to sitting at the toilet and having ready access to toilet paper at a mounting location such as toilet paper brackets mounted on the wall or on a stand-alone unit placed within reaching distance from a seated position on the toilet.

Some proposed solutions have attempted to overcome this challenge by wholly replacing the toilet paper roll with a wet-wipe container hung from the toilet roll brackets. Though this places the wipes in a convenient location, it does so by eliminating traditional access to toilet paper. Market research suggests that the majority of wet-wipe consumers also use toilet paper while seated at the toilet.

Further systems have attempted to provide access to both wet wipes and toilet paper at the toilet roll bracket by limiting the size of the toilet paper roll or by providing a relatively small amount of wet wipes which are stored within the wet-wipe dispenser. The challenge with these options is that they create an experience that is much less convenient because the consumer is required to refill the toilet paper roll or the wet wipes on a much more frequent interval.

For example, some approaches use the core of the toilet paper roll to store wet wipes. U.S. Pat. No. RE45,809E attempts to provide a way to dispense wet wipes in a bathroom by utilizing the space in the core of the toilet paper roll. This design utilizes the existing installations of toilet roll brackets without requiring modification or new equipment. However, the design of RE45,809E does not resolve the concern of extremely limited storage space for wet wipes available inside the core of the toilet paper roll. The design further limits the wet wipe storage space by placing other mechanical features such as the spring (and other pieces required for the functionality of the device) inside the core of the toilet paper. Additionally, because of the opening on the end of the device for dispensing of wet wipes, it does not provide a complete barrier to prevent the loss of moisture from the wet wipes stored inside the device.

BRIEF DESCRIPTION OF THE DRAWINGS

The present invention is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
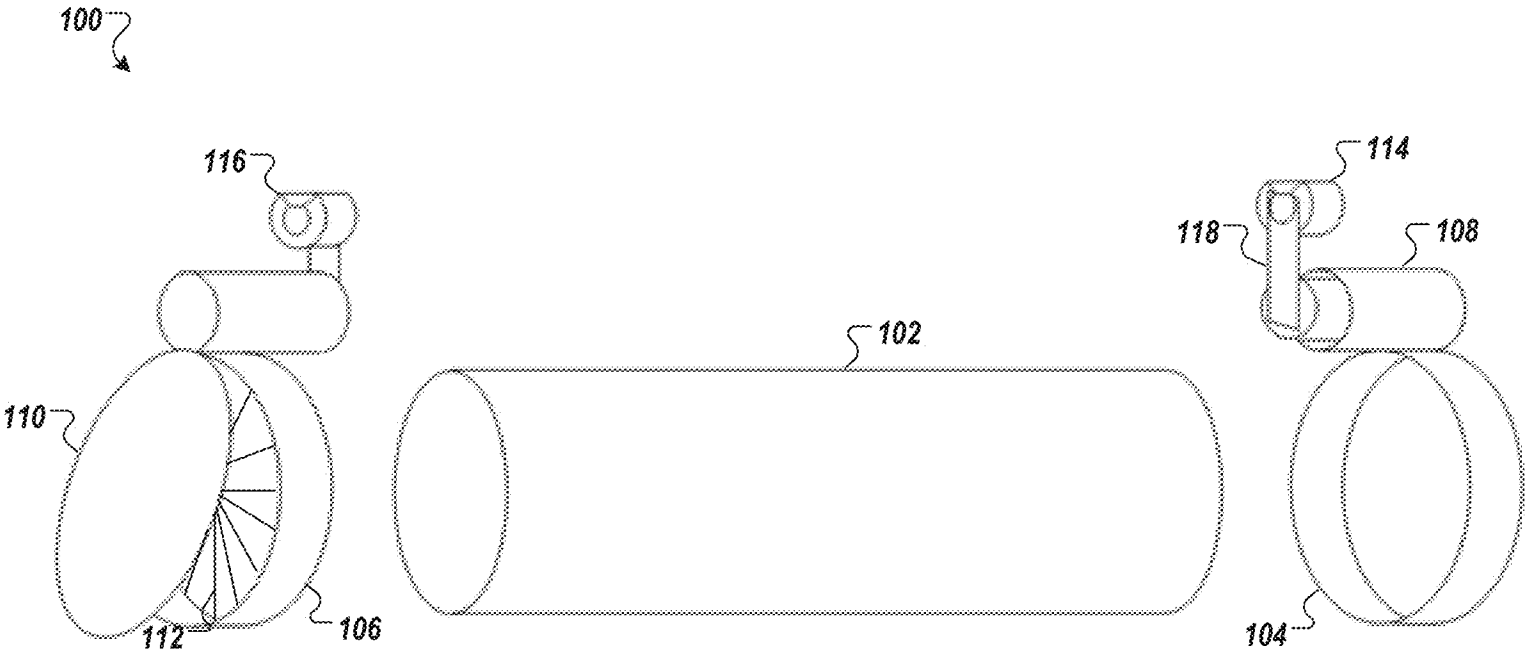
FIG. 1 is a schematic diagram of one embodiment of a toilet paper roll holder.

A wipe as used herein may be a paper, a tissue, a woven cloth, or a nonwoven cloth that is used for wiping, cleaning, or both. The wipe can be subjected to light rubbing or friction to remove dirt, liquid, or other material from a surface. Some wipes, such as those used while seated on a toilet, can be soaked in liquid to make the wipes "wet" or "moist" and are typically referred to herein as "wet wipes." The liquid may be water, cleaning liquid, moisturizer, or the like. Wipes are typically considered disposable, but can also be flushable. For example, disposable wipes can be nonwoven cloths. Described herein are systems and devices to store, and provide access to, personal care wipes (e.g., disposable wet wipes) for a subject while seated on a toilet. In the following description, numerous details are set forth.

In the embodiments described herein, a toilet paper roll holder is discussed which provides storage space for wipes by creating a multi-axis arrangement which provides a first axis for storing and dispensing wipes and toilet paper from a container body of a toilet paper roll holder, a second axis for connecting the container body to a toilet paper roll mounting location (such as a bracket), and a third axis to provide increased wipe storage space in the toilet paper roll holder not available on the first axis.

The toilet paper roll holder, described herein and referred to herein simply as "holder," may be installed at a location where a toilet paper roll and wipes may be accessible to a subject seated on a toilet seat. In the embodiments described herein, multiple wipes may be stored in an internal storage space of a container body of the holder. In some embodiments, the internal storage space may be located within a part of the holder that is at least partially within the toilet paper roll when the toilet paper roll is installed on the holder. However, the internal storage space is limited to the space located within the toilet paper roll when it is mounted between toilet paper roll brackets (or other location hardware). That limited space may be insufficient to accommodate a useful quantity of wipes, such as, for example, between 35-45 wipes. To increase the space available, some of the embodiments described herein may hold the toilet paper roll, and the container body, on an axis offset from the traditional axis for mounting the toilet paper roll between the toilet paper roll brackets. In one embodiment, a toilet paper holder includes an elongated container body that can store a useful quantify of wipes and fits within a hole in a toilet paper roll. The elongated container body is disposed on a first axis. At least one connector is coupled to the elongated container body and disposed on a second axis to secure the holder to a toilet roll bracket or other similar hardware. The holder also includes a bias member disposed on a third axis that is different from the first axis and the second axis. The bias member is coupled between the at least one connector and the elongated container body. The bias member permits the holder to be placed within the bracket and secured to the bracket, such as done by a conventional toilet paper roll holder that includes a spring-loaded rod. By placing the bias member in a third axis that is separate from the first and second axis, the elongated container body can have a length that is longer than a length between the brackets. This may allow storage space of the elongated container body to be extended, permitting a useful quantity of wipes to be stored within the holder. The storage space may be enclosed with at least one endcap which may also provide access to the stored wipes within the holder. The holder may include two connectors which extend from the container body to the toilet paper roll mounting location. The connectors engage with the mounting location to secure the holder and the installed toilet paper roll. The connectors may include one or more bias members to facilitate engagement with a range of different mounting location geometries and structural arrangements. Examples of various embodiments are described in more detail below with reference to the corresponding figures.

FIG. 1 is a schematic diagram of one embodiment of a toilet paper roll holder 100 with a wet-wipe container body. The illustrated embodiment of the holder 100 includes a container body 102. The illustrated container body 102 may be a circular cylinder, an elliptical cylinder, a tapered or variable cylinder, or have other geometries. The container body 102 may be referred to as an elongated structure as the longitudinal axis of the container body 102 is greater than its diameter. In some embodiments, the container body 102 is a metal, plastic, paper, or hybrid material. The container body 102 may be a reusable container or a disposable container. In some embodiments, the container body 102 may receive a disposable wipe package to dispense the wipes from the container body 102. The container body 102 may also receive the wipes, independent of any other packaging, for dispensing. In some embodiments, the container body 102 may be a disposable container that is pre-loaded with wipes.

In some embodiments, the container body 102 may include attachment interfaces (not shown) at one or both ends of the container body 102 to facilitate connection with a first endcap 104 and a second endcap 106. The attachment interfaces may include a threaded region, a friction surface, a snapping channel, a magnet, locking tabs/grooves, or other structure which removably secures the endcaps 104 and 106 to the container body 102. In some embodiments, the container body 102 may rotate freely relative to the endcaps 104 and 106 in a secured arrangement. This rotational aspect may assist in dispersing fluid through stored wet wipes within the container body 102 as toilet paper is removed from the installed toilet paper roll by rotating the toilet paper roll.

In the illustrated embodiment, the first endcap 104 engages with the container body 102. The first endcap 104 may be an annulus with a closed end to close an open end of the container body 102. The first endcap 104 may create a seal to prevent the escape of moisture from an interior of the container body 102. Alternatively, the first endcap 104 may be closed to retain a wipe cartridge within the container body 102 during use. In another embodiment, the first endcap 104 may be an open annulus to engage the container body 102 at a closed end. The first endcap 104 may include other features as described in greater detail below. The second endcap 106 may include an annulus to attach to the container body 102 at an end opposite the first endcap 104. The second endcap 106 may include an open annulus with a lid 110. The lid 110 may be attached to the second endcap 106 with a mechanical hinge, a tab, a tether, or other connection. The lid 110 may interface with the endcap 106 by snapping, threading, magnetism, suction, sealing, adhesion, or other interface mechanisms.

The second endcap 106 may also include a friction structure 112. The friction structure 112 may retain some moisture within the container body 102 and also apply friction to a wipe as it is pulled through the second endcap 106. This applied friction may assist in separating an individual wipe from the wipes stored in the container body 102 as the wipe is pulled from the container body 102 through the friction structure 112. The friction structure 112 may also present a portion of the next wipe in the container body 102 in a position that is easily accessible. A similar friction structure 112 may also, or alternatively, be incorporated into an end of the container body 102 to retain stored wipes, hold a wipe in ready position, and apply friction to a wipe as the wipe is pulled through the friction structure 112. While the illustrated embodiment of the friction structure 112 takes the form of several radial cuts made in a membrane spanning an end of the second endcap 106, the friction structure 112 may also be a smaller diameter hole, a brush, a serrated edge, overlapping flanges, or one or more of another friction-causing arrangement.

In the illustrated embodiment, the first endcap 104 is attached to a bias member 108. The illustrated embodiment of the bias member 108 includes opposing cylinders with a spring element or other force element that allows relative movement of the cylinders. The bias member 108 may be coiled spring element, a non-coiled spring element, a hydraulic element, a pneumatic element, a gas element, a magnetic element, a piezoelectric element, an elastic element, or some other force element. In the illustrated embodiment, the bias member 108 is located on an axis parallel to but offset from an axis of the container body 102. The bias member 108 allows for relative movement between the first endcap 104 and the connector 114.

The connector 114 is offset from the axis of the container body 102 as well as offset from the axis of the bias member 108. The connector 114 engages with a toilet paper mounting location such as a toilet paper roll mounting bracket. The connector 114 may include a post that may be inserted into a recessed portion of a toilet paper roll mounting location. In some embodiments, the connector 114 may have a conical or pyramidal form. The connector 114 may be rounded, angled, tapered, or have some other geometry to engage a structure at the mounting location. Further embodiments of the geometry of the connector 114 are described below. In some embodiments, the connector 114 may be made of, or coated with, a material to increase friction or retention of the connector 114 in the mounting location. The connector 114 may be fixed or free to rotate or move relative to the bias member 108. For example, the connector 114 may include a post which is free to spin in order to allow the rest of the holder 100 to rotate around the post of the connector 114. The holder 100 may also include a second connector 116 similar to the connector 114 descried above. The connectors 114 and 116 may apply force on a second axis parallel to, and offset from, the axis of the container body 102. The force applied by the connectors 114 and 116 may be in opposite directions. In the illustrated embodiment, the connectors 114 and 116 apply a force away from a vertical centerline of the holder 100. Other embodiments may apply forces in other manners to facilitate mounting the holder 100 at different structures of the mounting location.

In some embodiments, the connector 114 may be connected to bias member 108 by an arm 118. The arm 118 may be fixed or flexible. In some embodiments, the arm 118 may replace the bias member 108. For example, the arm 118 may be curved or straight and have a degree of flexibility sufficient to accommodate a variety of mounting locations. As another example, if the mounting location includes a bracket that is thicker or has the recessed portion set back from an edge of the bracket, the arm 118 may be longer. If the recessed portion of the bracket is smaller, the arm 118 may be shorter. In some embodiments, the arm 118 may be interchangeable to allow a subject to adjust the offset of the bias member 108 or container body 102 from the connector 114 based on the mounting location arrangement, size of the toilet paper roll, etc. Other embodiments may include a connector 114 with the arm 118 incorporated in a unified structure. In further embodiments, the connector 114, arm 118, and a portion of the bias member 108 may be unified. Other arrangements, unifications, or subdivisions of the components may also be incorporated.

Figure 2:
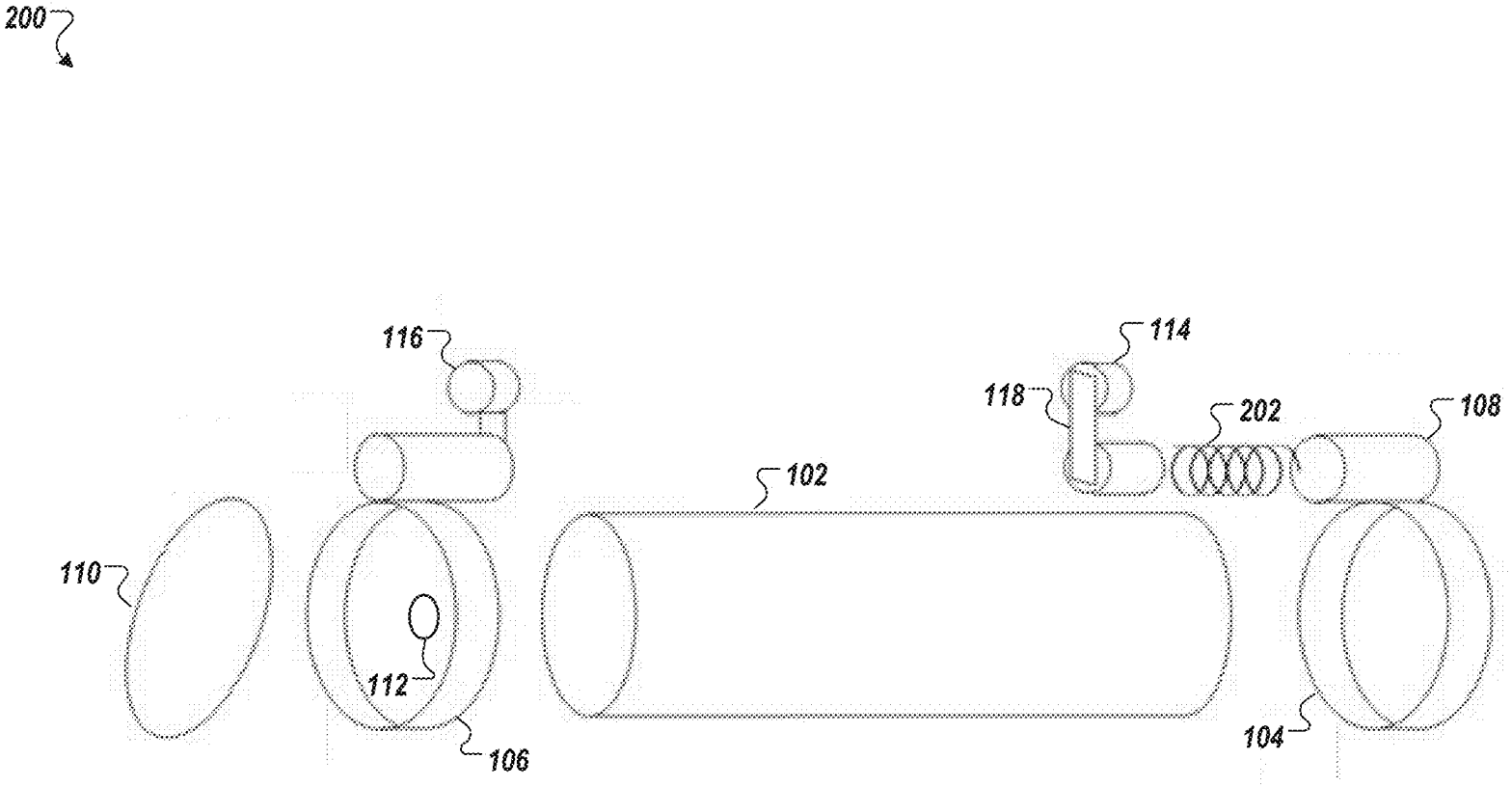
FIG. 2 is an exploded view of the toilet paper roll holder of FIG. 1.

FIG. 2 is an exploded view 200 of the toilet paper roll holder 100 of FIG. 1. The illustrated embodiment includes an bias member 108 with a coiled spring element 202 between the opposing cylinders of the bias member 108. As described above, other elements may be substituted and achieve the same or similar effect of allowing relative movement between the container body 102 and the connector 114. Additionally, an alternative friction structure 112 is shown. In this embodiment, the friction structure 112 is a relatively small diameter hole through which the wipes may be pulled from the container body 102. The shape and size of the friction structure 112 provides retention of moisture, application of friction to aid in separation of wipes, and convenience in holding the next wipe in a readily accessible position for the subject. As described above, the friction structure 112 may have other geometries.

Figure 3:
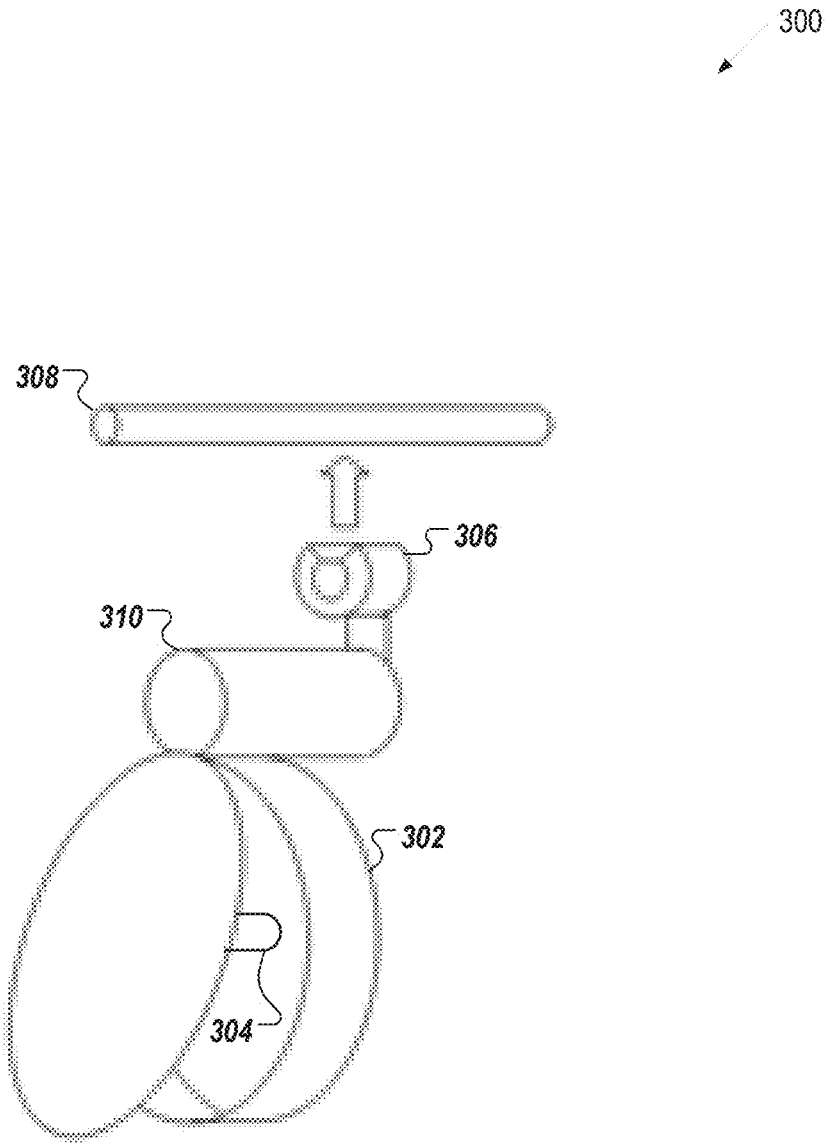
FIG. 3 is a schematic diagram of one embodiment of a connector arrangement of a toilet paper roll holder.

FIG. 3 is a schematic diagram of one embodiment of a connector 306 of a toilet paper roll holder 300. In the illustrated embodiment, the connector 306 is a clip to engage and retain a mounting location such as a rod 308. Some traditional mounting locations include a relatively small diameter rod onto which a traditional toilet paper roll with a relatively large inner diameter may be hung. The illustrated connector 306 may snap onto the rod 308 to secure the holder 300 to the rod 308. The connector 306 may be an elastic clamp, a hook, a strap, a magnet, a locking clasp, a gated clasp, a closed loop, or other structure.

The illustrated embodiment also includes a friction structure 304. In this embodiment, the friction structure 304 is a slot formed in the second endcap 302. As described herein, the friction structure 304 may take other forms. In some embodiments, the second endcap 302 may be attached to a secondary structure 310. The secondary structure 310 may be an bias member similar to the bias member 108 of FIG. 1. The secondary structure 310 may also be fixed (non-adjustable) and orient the connector 306 to align with a mounting location while providing additional capacity in the holder for wipes as discussed above.

Figure 4:
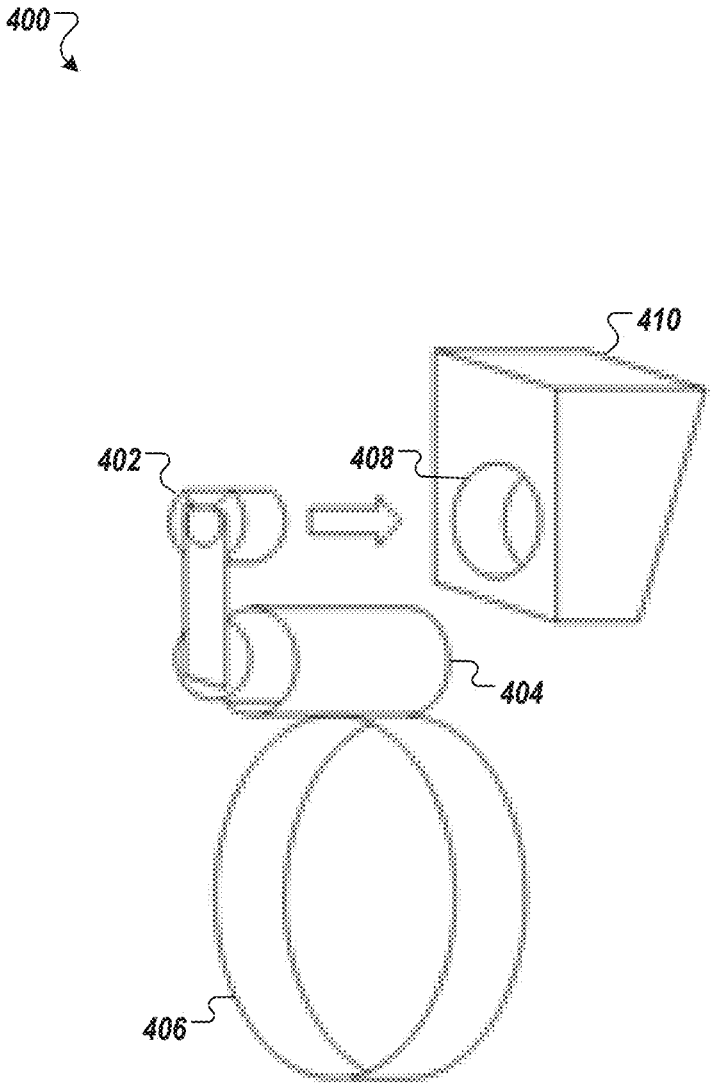
FIG. 4 is a schematic diagram of another embodiment of a connector arrangement of a toilet paper roll holder.

FIG. 4 is a schematic diagram of another embodiment of a connector 402 of a toilet paper roll holder 400. In the illustrated embodiment, the connector 402 is connected to an bias member 404. The bias member 404 is coupled to the endcap 406. The bias member 404 allows for relative movement of the connector 402 with respect to the endcap 406 to facilitate alignment of the connector 402 with a recessed surface 408 of the mounting location 410. The bias member 404 also allows for movement of the connector 402 to engage and disengage with the recessed surface 408. In the illustrated embodiment, the recessed surface 408 has a circular geometry. The connector 402 has a corresponding geometry. In some embodiments, the connector 402 may be changed out or modified to correspond with the geometry of the recessed surface 408 or other feature of the mounting location 410 as described herein.

Figure 5:
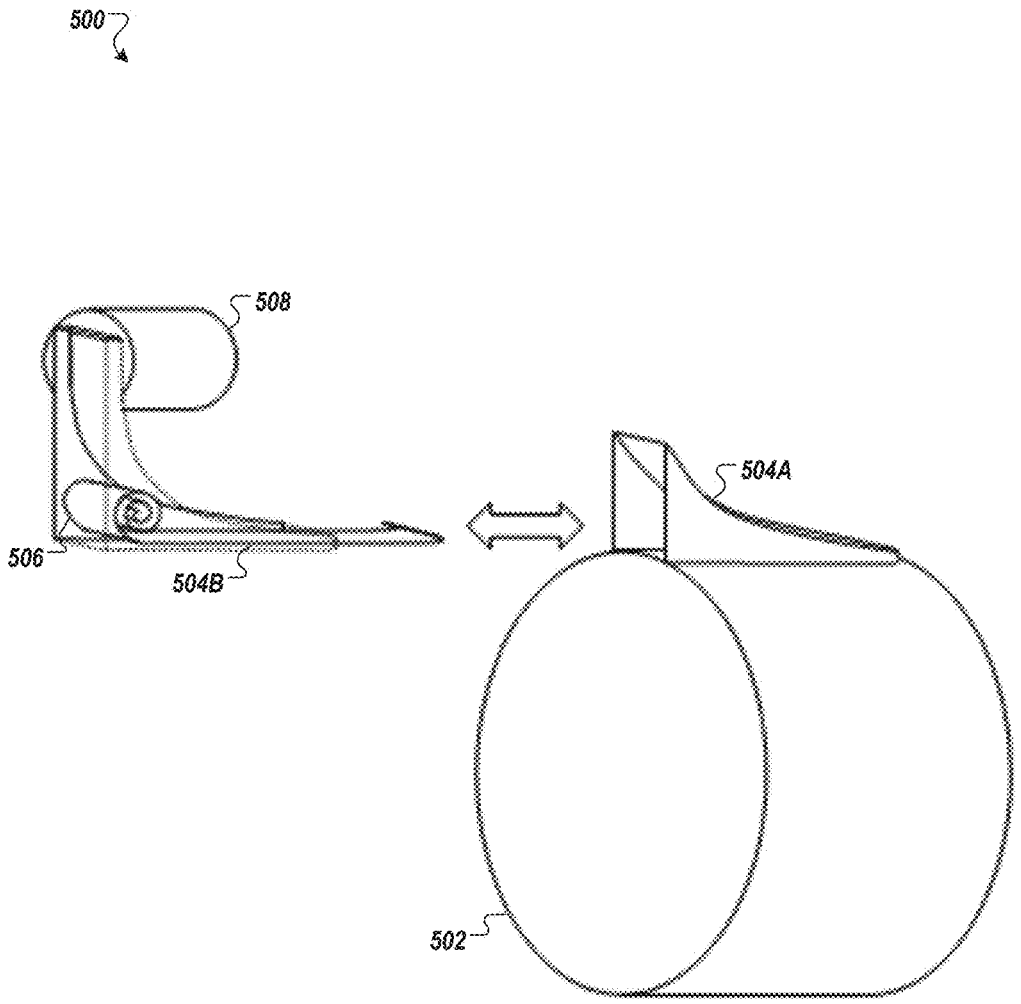
FIG. 5 is a schematic diagram of one embodiment of a bias member of a toilet paper roll holder.

FIG. 5 is a schematic diagram of one embodiment of an bias member 504 of a toilet paper roll holder 500. In the illustrated embodiment, the bias member 504 includes a first portion 504A and a second portion 504B. The first portion 504A is coupled to an endcap 502. In the illustrated embodiment, the first portion 504A is a tapered design corresponding to the tapered design of the second portion 504B. The second portion 504B includes a rolled spring 506. The rolled spring 506 provides retention of the second portion 504B within the first portion 504A. The end of the rolled spring 506 may extend from the second portion 504B to interface with a corresponding retention feature of the first portion 504A. For example, the rolled spring may be retained within the first portion 504A so that movement of the second portion 504B out of the first portion 504A will apply force to unwind the rolled spring 506 which, in turn, applies an equal and opposite force on the second portion 504B tending to force the second portion 504B back into a resting position within the first portion 504A. Accordingly, the connector 508, which is coupled to the second portion 504B, is forced into a surface feature of a mounting location that may be similar to the surface feature 408 described with respect to FIG. 4. In some embodiments, the rolled spring 506 may be replaced with, or supplemented by, other force elements.

Figure 6:
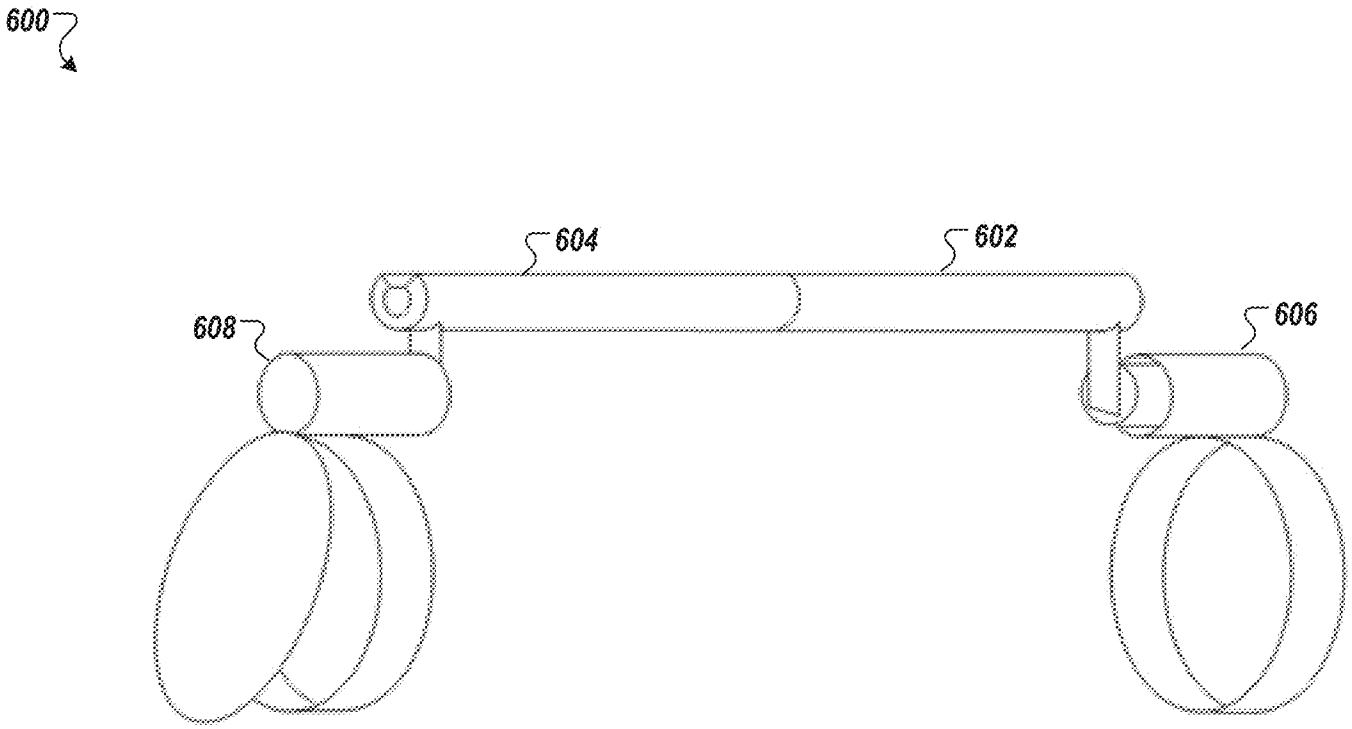
FIG. 6 is a schematic diagram of another embodiment of a toilet paper roll holder.

FIG. 6 is a schematic diagram of another embodiment of a toilet paper roll holder 600. In the illustrated embodiment, the first connector 602 is coupled to the second connector 604. The first and second connectors 602 and 604 may be joined to form a single unified connector. In some embodiments, the first and second connectors 602 and 604 may include a coupling mechanism to facilitate a mutual interface between the connectors 602 and 604 to increase stability and flexibility in the holder 600. In one embodiment, the first or second connector 602 and 604 may allow for one of the first and second connectors 602 and 604 to be inserted into the other. This may allow for additional adjustability and retaining force in a mounting location to supplement the force and adjustability afforded by the first bias member 606. With the connectors 602 and 604 in the illustrated arrangement, the holder 600 may also remain in the mounting location even without a container body in place. This allows for changing or replacement of the toilet paper roll and or wipe container without having to remove the holder 600 from the mounting location.

Additionally, a second bias member 608 may be incorporated, opposite the first bias member 606, to allow for further adjustability in the holder 600. The adjustability described above may facilitate installation and removal of the holder 600 at a mounting location. The adjustability may also facilitate installation and replacement of a container body (not shown) which may be a disposable or non-disposable. The adjustability may also facilitate reloading of wipes into the holder 600.

Figure 7:
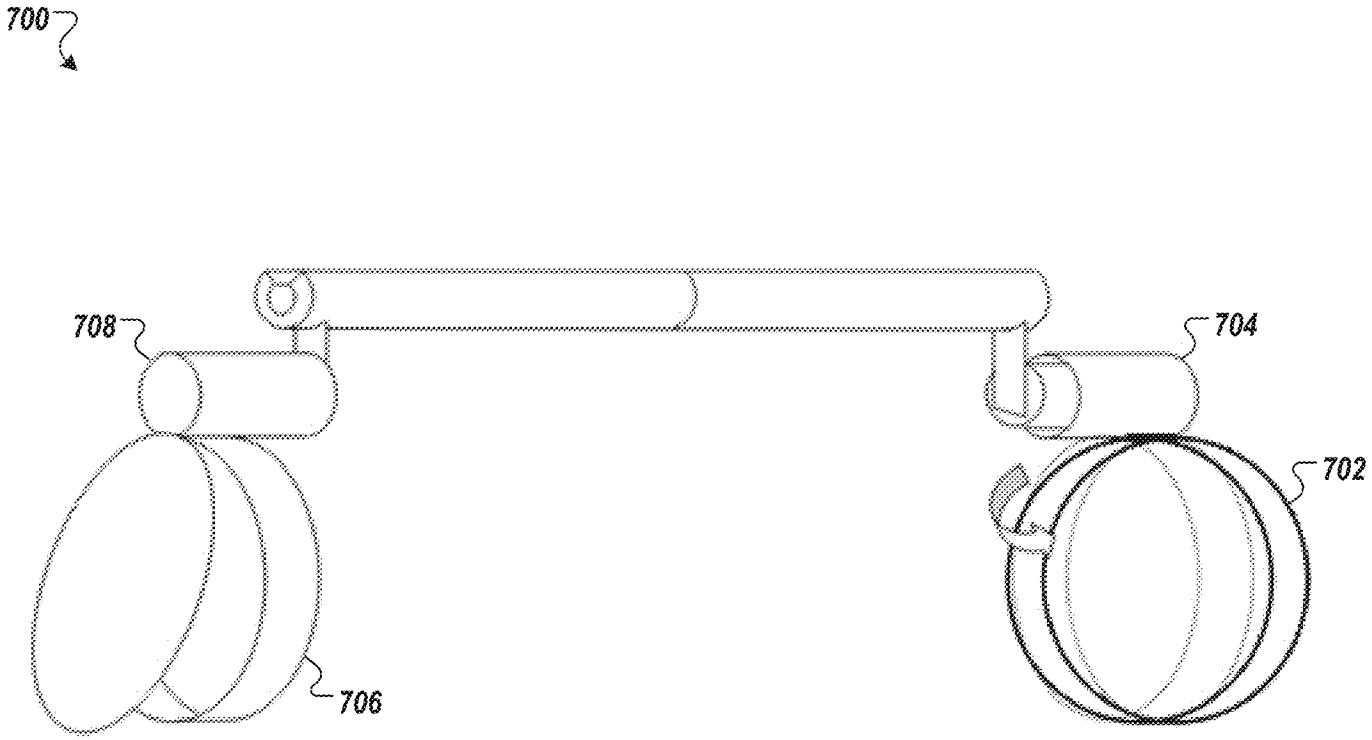
FIG. 7 is a schematic diagram of another embodiment of a toilet paper roll holder with a rotating endcap.

FIG. 7 is a schematic diagram of another embodiment of a toilet paper roll holder 700 with a rotating endcap 702. In the illustrated embodiment, the first endcap 702 is able to rotate at a coupling point with a first bias member 704. In this embodiment, the first endcap 702 rotates about a vertical axis. In some embodiments, the rotation of the first endcap 702 may facilitate loading or reloading of the holder 700 with wipes or a container of wipes. In some embodiments, the second endcap 706 may also rotate with respect to a secondary structure 708 which may include an bias member similar to the first bias member 704. Other rotations of the endcaps 702 and 706 may also be incorporated.

Figure 8:
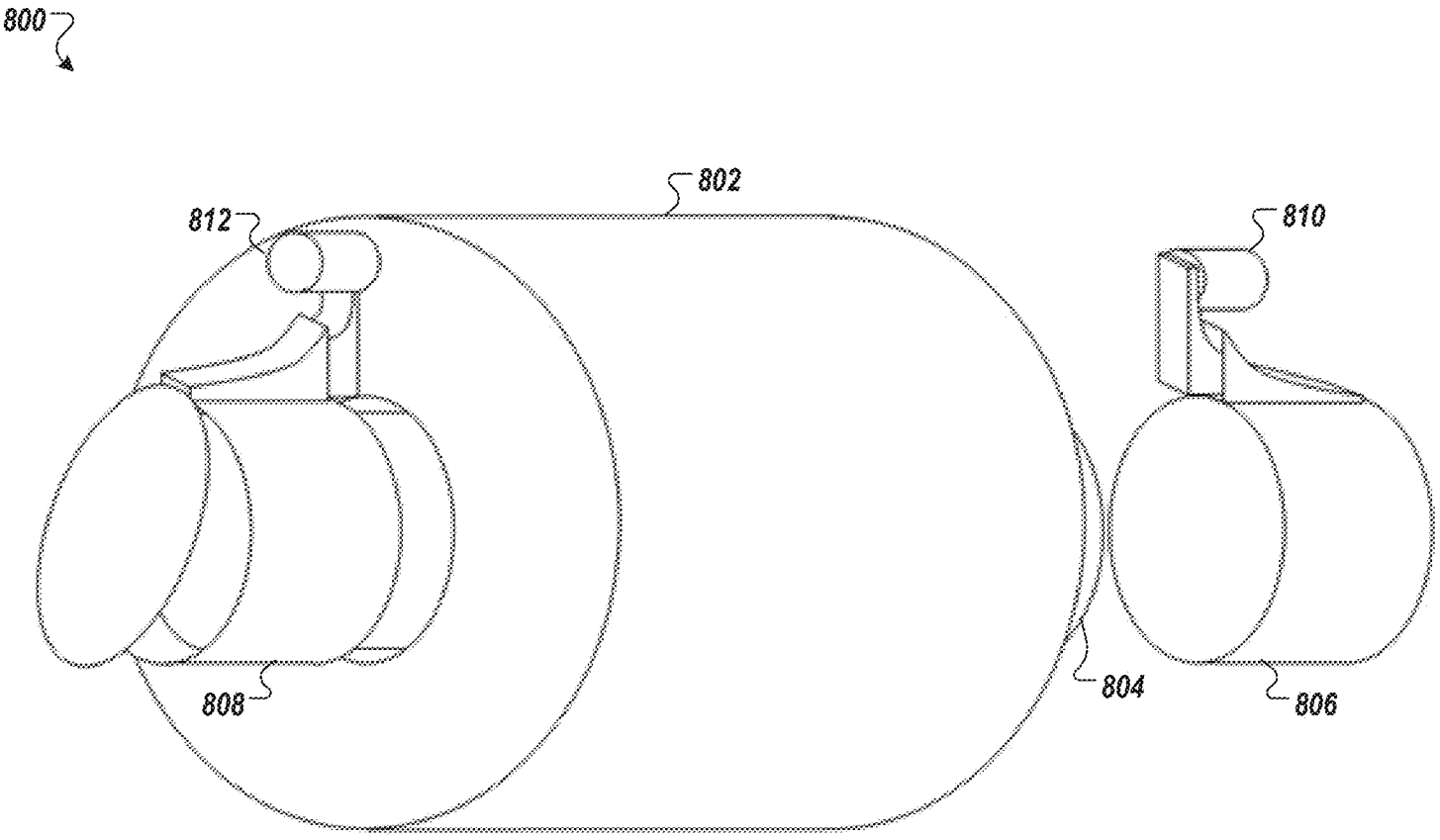
FIG. 8 is a schematic diagram of another embodiment of a toilet paper roll holder with a toilet paper roll installed.

FIG. 8 is a schematic diagram of another embodiment of a toilet paper roll holder 800 with a toilet paper roll 802 installed. In the illustrated embodiment, the toilet paper roll 802 is installed on the holder 800 by inserting the container body 804 into the open center of the toilet paper roll 802. In the depicted embodiment, the container body 804 is elongated to a length longer than the axis of the toilet paper roll 802. Thus, the internal storage space of the container body 804 is not limited to the space within the bounds of the interior of the toilet paper roll 802.

In some embodiments, the container body 804 may be an elliptical cylinder to apply a resistive force to the inside of the toilet paper roll 802 to prevent unwanted unspooling of the toilet paper roll 802 by children, pets, during transit in a motorhome or portable outhouse, etc. The container body 804 may also be a circular cylinder to more closely match the geometry of the interior surface of the toilet paper roll 802. The container body 804 may have a geometry to allow the toilet paper roll 802 to rotate freely with limited friction on the container body 804 or apply a friction to maintain the toilet paper roll 802 in place relative to the container body 804 and allow the container body 804, with the toilet paper roll 802 attached, to rotate in the endcaps 806 and 808.

In the illustrated embodiment, the first endcap 806 and the second endcap 808 may be coupled to the container body 804. The endcaps 806 and 808 may couple to the container body 804 as described above. The endcaps 804 and 806 may apply a frictional force to the toilet paper roll 802 or allow clearance for the toilet paper roll 802 to rotate without contact against the endcaps 804 and 806. The connectors 810 and 812 may be situated at a given length along a radius of the toilet paper roll 802. For example, the connectors 810 and 812 may be located on an axis that is tangential to the outer surface of a new toilet paper roll 802. Other arrangements and placements of the connectors 810 and 812 may be incorporated.

In the above description, specific details of various embodiments are provided. However, some embodiments may be practiced with less than all of these specific details. In other instances, certain aspects, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A system comprising:

an elongated container body comprising a first axis central to the elongated container body, an internal storage space, a first end, and a second end, wherein the elongated container body fits within a toilet paper roll;

a first endcap coupled to the first end of the elongated container body;

a second endcap coupled to the second end of the elongated container body, wherein the second endcap comprises an access lid to provide access to the internal storage space of the elongated contain body;

at least one connector, outside of the internal storage space, to secure the system relative to a mounting location on a second axis parallel to and offset from the first axis; and a bias member disposed on a third axis parallel to and between the first axis and the second axis, wherein the bias member is coupled between the at least one connector and the elongated container body.

2. The system of claim 1, wherein the elongated container body comprises a circular cylinder with at least one of the first end and the second end open.

3. The system of claim 1, wherein the elongated container body comprises an elliptical cylinder with at least one of the first end and the second end open.

4. The system of claim 1, wherein the at least one connector comprises a force application structure to apply a force to the mounting location.

5. The system of claim 1, wherein the bias member provides for relative motion of the at least one connector with respect to the elongated container body to accommodate a geometry of the mounting location.

6. The system of claim 5, wherein the bias member comprises a spring element.

7. The system of claim 1, wherein the access lid comprises a hinge.

8. The system of claim 1, wherein the elongated container body comprises an internal geometry to fit a disposable wipe within the internal storage space.

9. The system of claim 1, wherein the elongated container body comprises a disposable wipe container and the first endcap and the second endcap are removably coupled to the elongated container body.

10. The system of claim 1, wherein the second endcap further comprises a friction structure extending towards a central axis of the second endcap to apply a force to wet wipes pulled from the internal storage space.

11. A device comprising:

a first endcap comprising:

a first annular receiver to interface coaxially with a first end of an elongated container body with a first axis;

a first connector to interface with a first portion of a toilet paper roll mounting location on a second axis; and a first bias member on a third axis between the first receiver and the first connector to provide relative movement of the first connector with respect to the first receiver; and a second endcap comprising:

a second annular receiver to interface coaxially with a second end of the elongated container body on the first axis;

a second connector to interface with a second portion of the toilet paper roll mounting location on the second axis;

a second bias member on the third axis between the second receiver and the second connector to provide relative movement of the second connector with respect to the second receiver; and a lid coupled to the second receiver to provide access through the second endcap to the elongated container body.

12. The device of claim 11, wherein the first bias member and the second bias member comprise at least one of a coiled spring element, a non-coiled spring element, a hydraulic element, a gas element, a magnetic element, an elastic element, or a mechanical element.

13. The device of claim 11, wherein the first endcap and the second endcap form a unified structure.

14. The device of claim 11, wherein the first endcap comprises a first coupling structure to engage with a first corresponding structure of the elongated container body and the second endcap comprises a second coupling structure to engage with a second corresponding structure of the elongated container body.

15. The device of claim 11, wherein the first bias member applies a force to the first portion of the toilet paper roll mounting location via the first connector and the second bias member applies a force to the second portion of the toilet paper roll mounting location via the second connector.

16. The device of claim 11, wherein the second endcap further comprises a friction structure extending inward from an inner surface of the first annular receiver towards the first axis.

17. The device of claim 11, wherein the first connector comprises a first post to insert into a first recess of the first portion of the toilet paper roll mounting location and the second connector comprise a second post to insert into a second recess of the second portion of the toilet paper roll mounting location.

18. The device of claim 11, wherein the first connector comprises a first clip to engage the first portion of the toilet paper roll mounting location and the second connector comprises a second clip to engage the second portion of the toilet paper roll mounting location.

19. The device of claim 11, wherein the elongated container body comprises a disposable wipe container.

20. The device of claim 11, wherein the elongated container body comprises an internal geometry to fit a disposable wipe within an internal storage space of the elongated container body.

* * * * *